US007017206B1

(12) United States Patent
Kedineoglu

(10) Patent No.: US 7,017,206 B1
(45) Date of Patent: Mar. 28, 2006

(54) BAG AND TOWEL COMBINATION

(76) Inventor: Nadia Kedineoglu, 344 Oakwood St., Montebello, CA (US) 90640

( * ) Notice: Subject to any disclaimer, the term of this patent is extended or adjusted under 35 U.S.C. 154(b) by 0 days.

(21) Appl. No.: 10/929,149

(22) Filed: Aug. 30, 2004

(51) Int. Cl.
*A45C 9/00* (2006.01)

(52) U.S. Cl. ..... 5/417; 5/420

(58) Field of Classification Search ..... 5/417, 5/420; 383/4; 190/1–2
See application file for complete search history.

(56) References Cited

U.S. PATENT DOCUMENTS

| | | | | |
|---|---|---|---|---|
| 4,101,994 | A | 7/1978 | Hoyt | |
| 4,154,323 | A * | 5/1979 | Sneider | 190/2 |
| 4,197,891 | A | 4/1980 | Comollo | |
| 4,375,111 | A | 3/1983 | Hall | |
| 4,506,769 | A * | 3/1985 | Franco et al. | 190/108 |
| 4,516,668 | A | 5/1985 | Grayek | |
| D306,543 | S | 3/1990 | Pestuglicci | |
| 5,207,508 | A * | 5/1993 | Koutsis, Jr. | 383/4 |
| 5,346,308 | A | 9/1994 | Buhot et al. | |
| D369,467 | S * | 5/1996 | Cole | D3/300 |
| 5,618,100 | A | 4/1997 | Sullivan | |
| 5,868,227 | A * | 2/1999 | Garcia | 190/112 |
| 5,941,638 | A | 8/1999 | Fonseca | |
| 6,276,828 | B1 | 8/2001 | Otley et al. | |

* cited by examiner

*Primary Examiner*—Heather Shackelford
*Assistant Examiner*—Fredrick Conley

(57) ABSTRACT

A bag and towel combination includes a bag assembly that includes a bottom wall and a peripheral wall that is attached to and extends upwardly from the bottom wall. The peripheral wall has an upper edge defining an opening extending into the bag assembly. The bottom wall has a generally rounded shape. The bag assembly has, a front side, a back side and a pair of lateral sides. A flexible panel has a first edge, a second edge, a third edge and a fourth edge. A coupling assembly includes a first mating portion and a second mating portion. The first mating portion is attached to the panel and is positioned generally adjacent to the first edge. The second mating portion is attached to an inner surface of the bag assembly. The first and second mating portions are removably coupled together.

6 Claims, 6 Drawing Sheets

BAG AND TOWEL COMBINATION

BACKGROUND OF THE INVENTION

1. Field of the Invention

The present invention relates to bag devices and more particularly pertains to a new bag device for holding and retaining a beach towel, wherein the bag may be used as a pillow attached to the beach towel.

2. Description of the Prior Art

The use of bag devices is known in the prior art. U.S. Pat. No. 6,276,828 describes a towel that can be converted into a tote bag, thereby not requiring a bag that is separate from the towel. Yet another such device is found in U.S. Pat. No. 4,516,668 that again shows a combination bag and towel wherein the bag is formed from the towel. Still yet another similar device is found in U.S. Pat. No. 5,6187,110.

While these devices fulfill their respective, particular objectives and requirements, the need remains for a bag and towel combination wherein the two are selectively attachable or removable from each other. Additionally, the bag should include additional pockets and the like so that it is more useful as a tote bag itself. Additionally, by utilizing a bag that is not formed from the towel, the bag may be used as a pillow while lying on the towel.

SUMMARY OF THE INVENTION

The present invention meets the needs presented above by generally comprising a bag assembly that includes a bottom wall and a peripheral wall that is attached to and extends upwardly from the bottom wall. The peripheral wall has an upper edge defining an opening extending into the bag assembly. The bottom wall has a generally rounded shape. The bag assembly has a front side, a back side and a pair of lateral sides. A flexible panel has a first edge, a second edge, a third edge and a fourth edge. A coupling assembly includes a first mating portion and a second mating portion. The first mating portion is attached to the panel and is positioned generally adjacent to the first edge. The second mating portion is attached to an inner surface of the bag assembly. The first and second mating portions are removably coupled together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
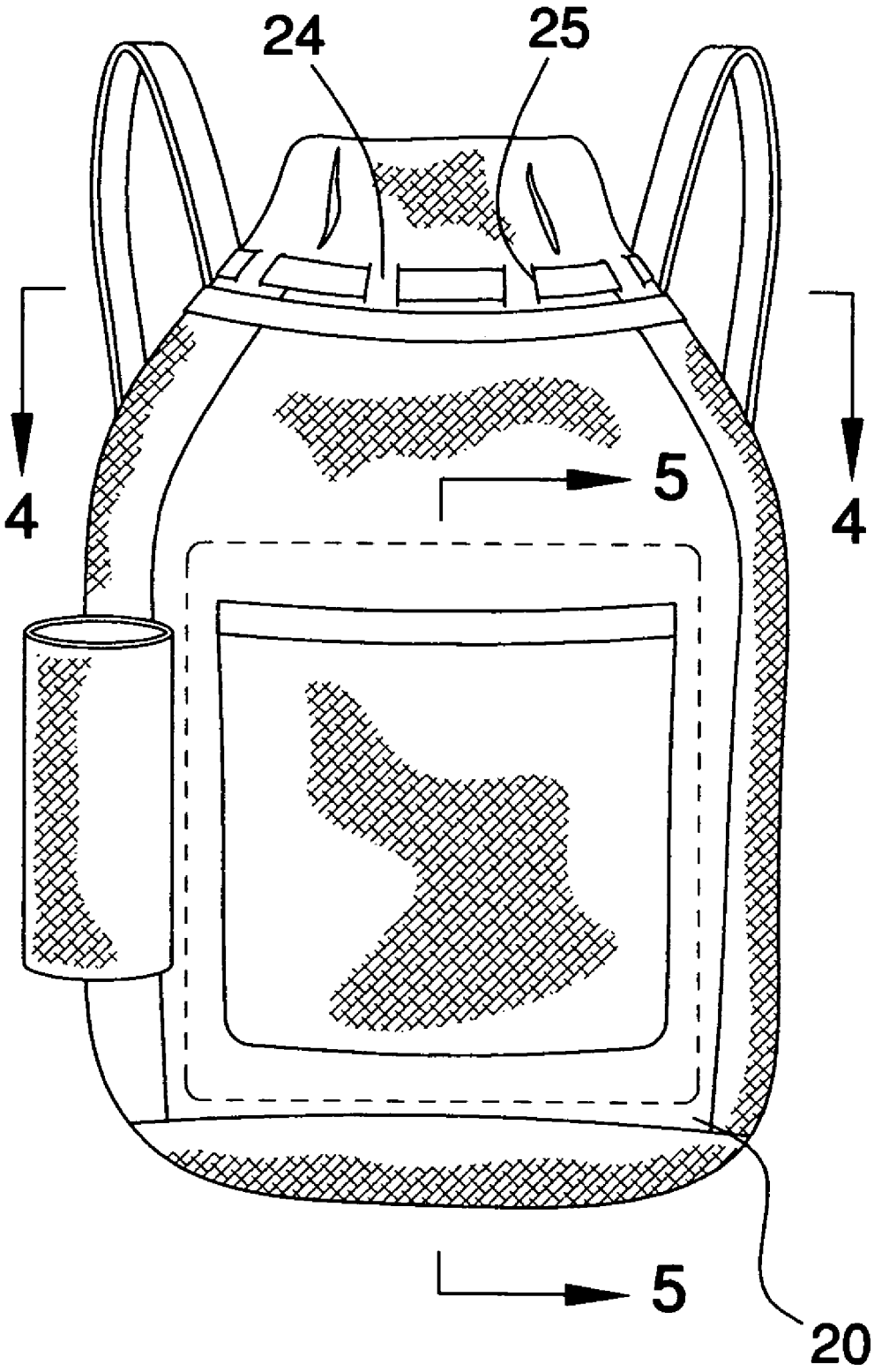
FIG. 1 is a front side view of a bag and towel combination according to the present invention.
Figure 2:
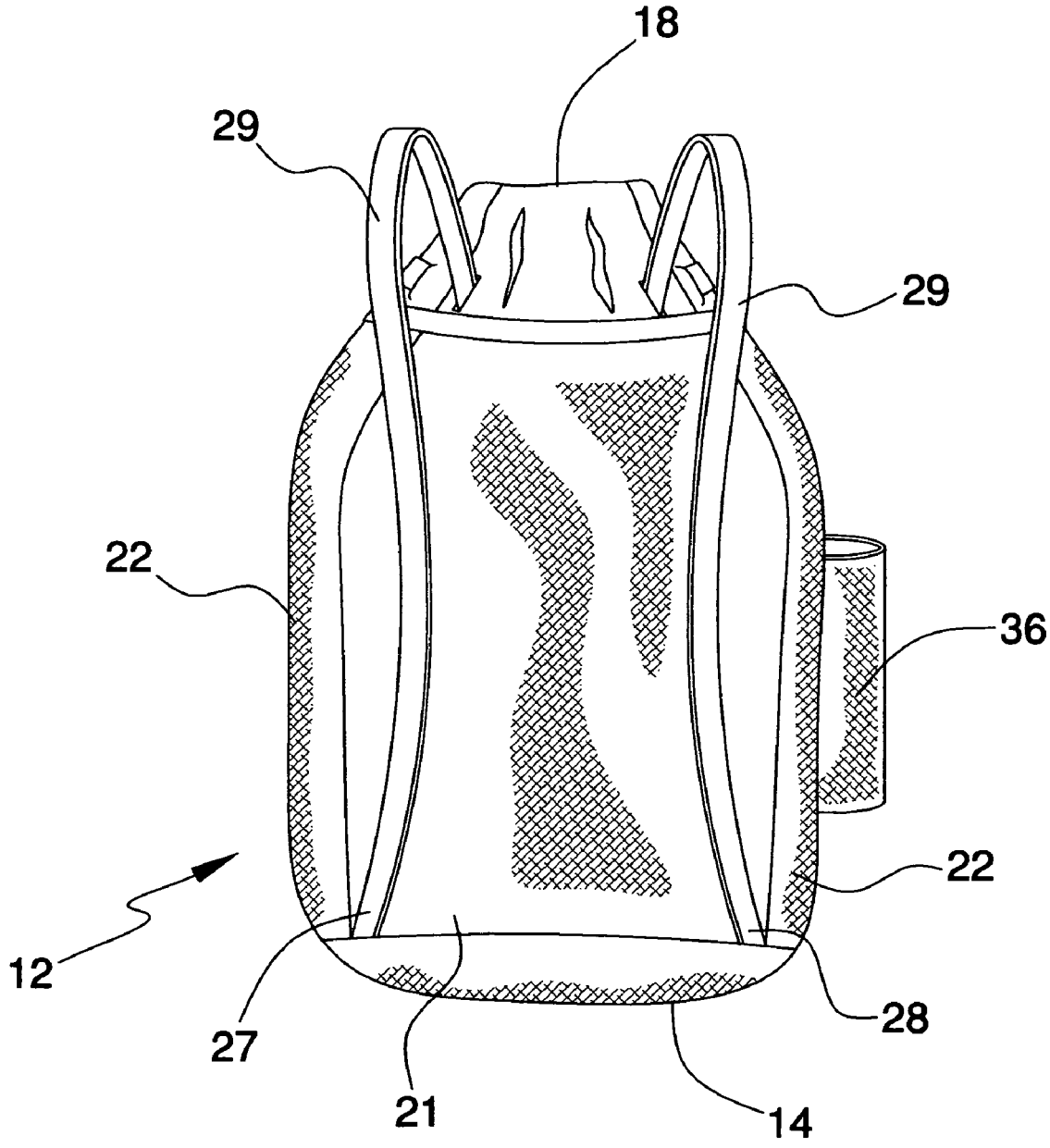
FIG. 2 is a back side view of the present invention.

With reference now to the drawings, and in particular to FIGS. 1 through 6 thereof, a new bag device embodying the principles and concepts of the present invention and generally designated by the reference numeral 10 will be described.

As best illustrated in FIGS. 1 through 6, the bag and towel combination 10 generally comprises a bag assembly 12 that includes a bottom wall 14 and a peripheral wall 16 that is attached to and extends upwardly from the bottom wall 14. The peripheral wall 16 has an upper edge 18 that defines an opening extending into the bag assembly 12. The bottom wall 14 has a generally rounded shape. The bag assembly 12 has a front side 20, a back side 21 and a pair of lateral sides 22. The bag assembly 12, or bag, is preferably constructed of a cloth material of either natural fibers, synthetic fibers or a combination thereof. Flexible plastic may also be utilized.

A plurality of loops 24 is attached to the peripheral wall 16. The loops 24 are positioned generally adjacent to the opening, or upper edge 18. The loops 24 are aligned with each other along the front 20 and lateral 22 sides. Slits 25 extending through the bag 12 may form the loops 24. An elongated flexible tether 26 has a first end 27 and a second end 28. The tether 26 extends through the loops 24 and acts as a cinching means for the bag 12. The first 27 and second 28 ends of the tether 26 are each attached to the back side 21 and are positioned generally adjacent to the bottom wall 14. The portions of the tether 26 extending from the loops 24 to the first 27 and second 28 ends form shoulder straps 29 for efficient carrying of the bag 12. A pocket 30 is attached to the front side 20. The pocket 30 preferably has an insulated lining 32 and a covering 34. The covering may be secured in a closed position with a hook and loop fastener 35. The lining 32 preferably includes a water impermeable material for protecting items positioned therein from water damage. A bottle holder 36 is attached to the bag assembly 12. The bottle holder 36 is preferably a cylindrically shaped container constructed of a cloth material.

A flexible panel 40 has a first edge 42, a second edge 44, a third edge 46 and a fourth edge 48. The flexible panel 40 has a length from the first edge 42 to the second edge 44 greater than 40 inches and a width from the third edge 46 to the fourth edge 48 greater than 30 inches. The panel 40 defines a conventional beach towel and is comprised of a cloth material.

A coupling assembly 50 includes a first mating portion 52 and a second mating portion 54. The first mating portion 52 is attached to the panel 40 and is positioned generally adjacent to the first edge 42. The second mating portion 54 is attached to an inner surface 13 of the bag assembly 12. The first mating portion 52 generally extends along the first edge 42 and the second mating portion 54 generally extends between the bottom wall 14 and the opening 18. The first 52 and second 54 mating portions are removably coupled together. The first 52 and second 54 mating portions preferably comprise a pair of zipper elements. Alternatively, the first and second mating portions may include a plurality of male and female snap connectors or a hook and loop fastening means.

Figure 3:
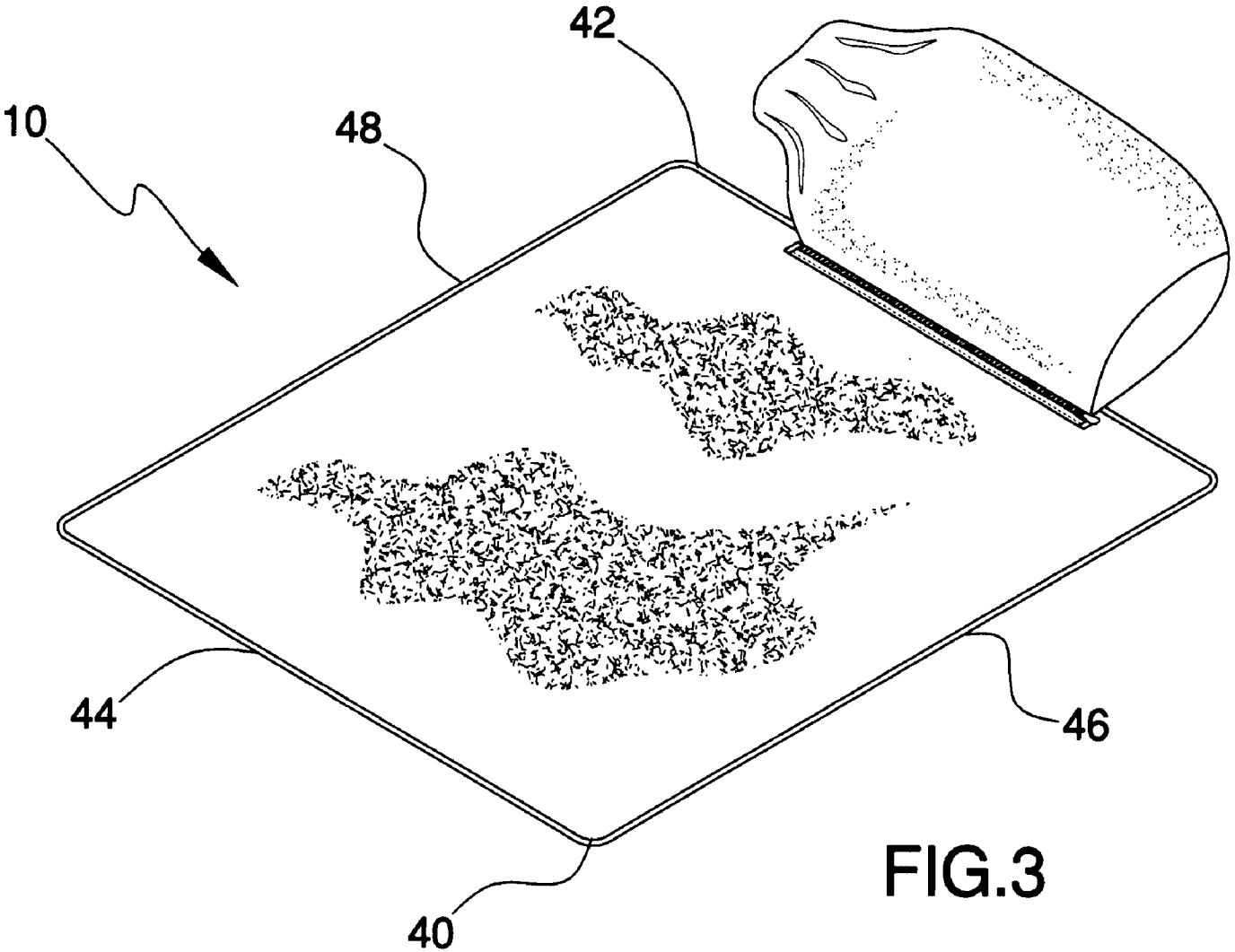
FIG. 3 is a perspective view of the present invention.
Figure 4:
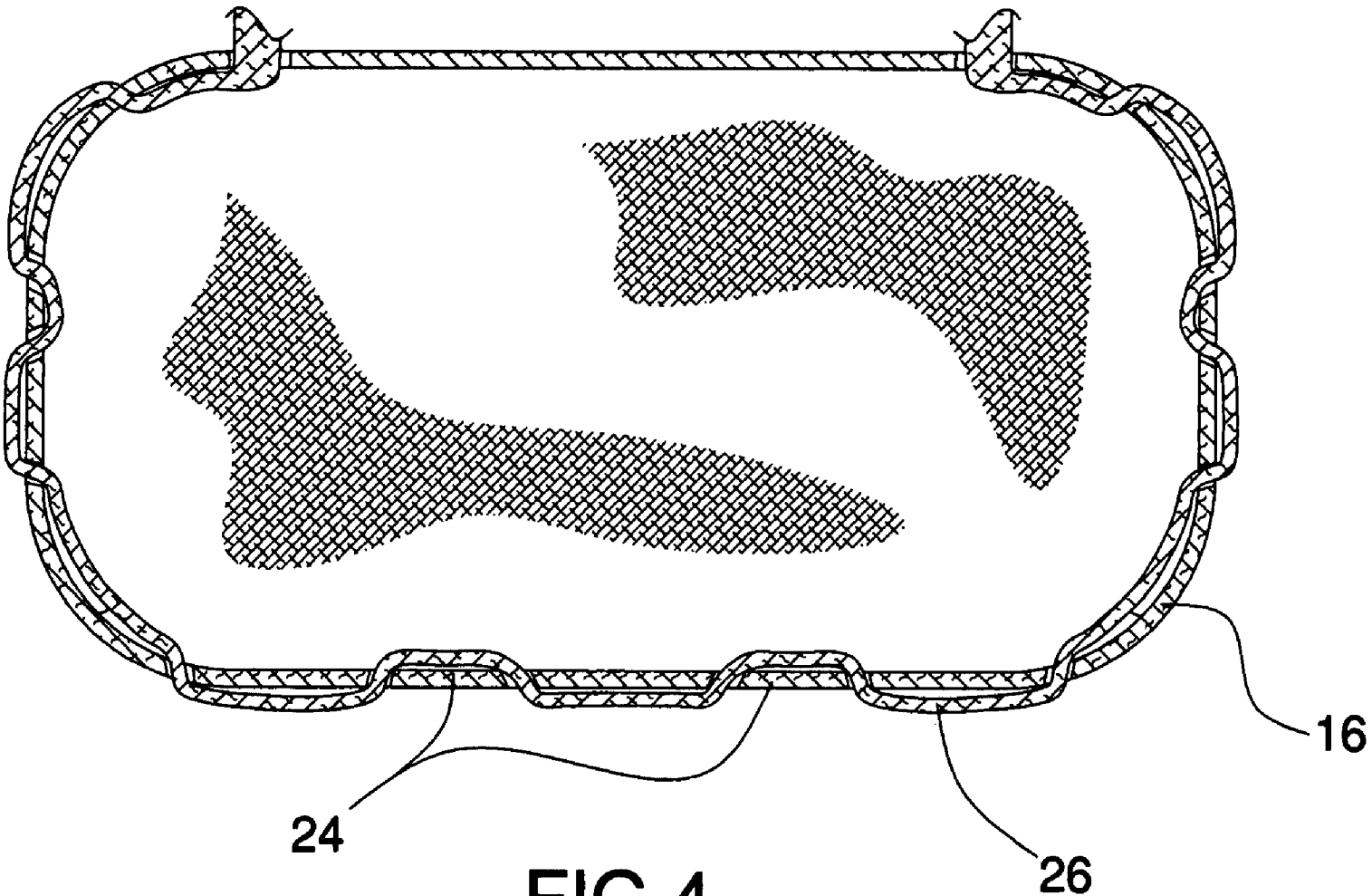
FIG. 4 is a cross-sectional view taken along line 4—4 of FIG. 1 of the present invention.
Figure 5:
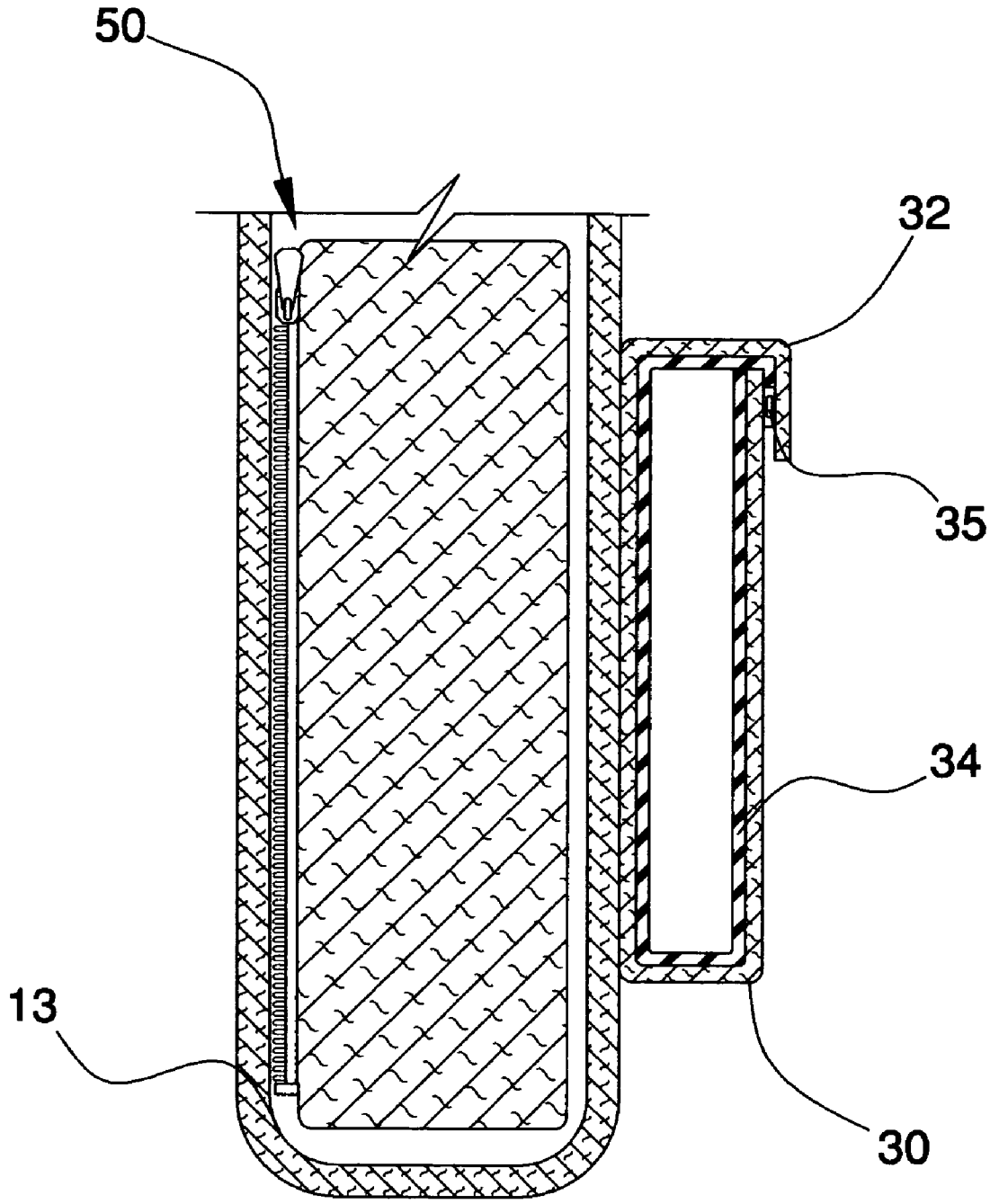
FIG. 5 is a cross-sectional view taken along line 5—5 of FIG. 1 of the present invention.
Figure 6:
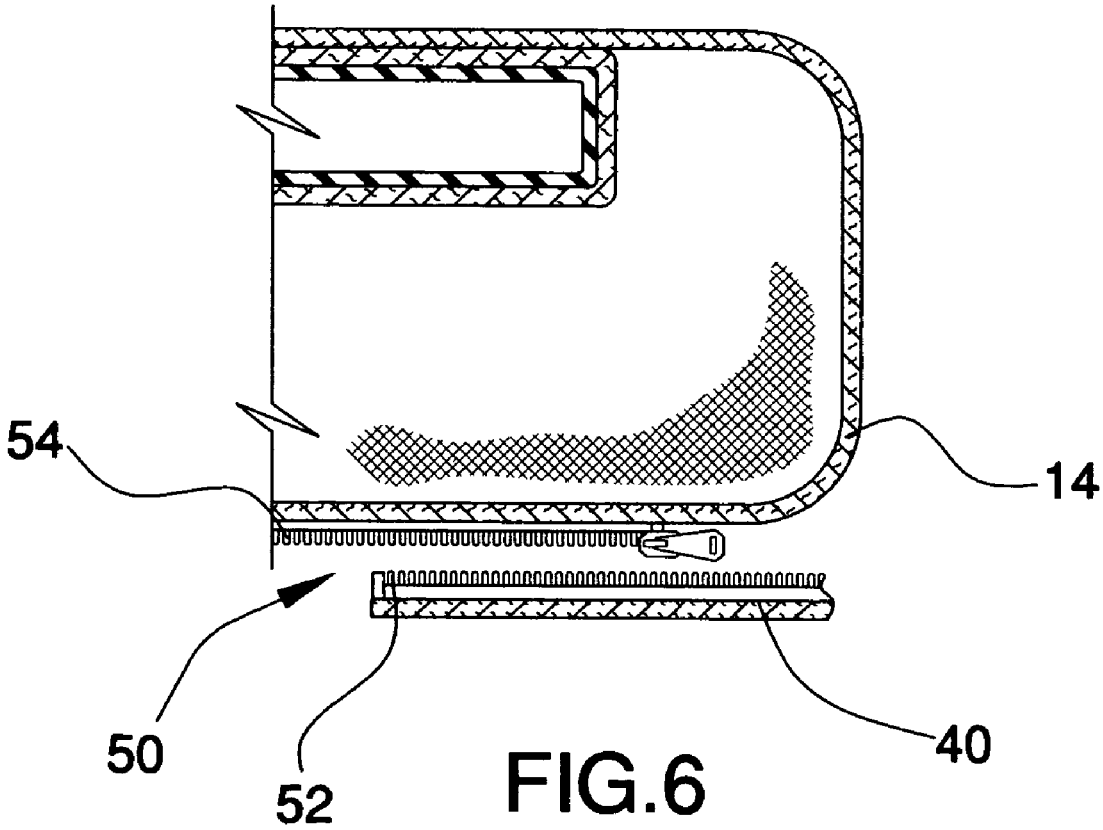
FIG. 6 is a side cross-sectional view of the present invention.

In use, the bag 12 is used as a conventional bag and is more particularly well suited for holding the panel 40 until its use. The panel 40 is attached to the bag 12 so that it is not easily lost. When in use, the panel 40 may be pulled from the bag 12 and the bag 12 turned inside out as shown in FIG. 3 so that the panel 40 is still attached to the bag 12. This allows the bag 12 to be used as a pillow.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tote bag and beach towel combination apparatus comprising:

a bag assembly including a bottom wall and a peripheral wall being attached to and extending upwardly from said bottom wall, said peripheral wall having an upper edge defining an opening extending into said bag assembly, said bottom wall having a generally rounded shape, said bag assembly having a front side, a back side and a pair of lateral sides;

a flexible panel having a first edge, a second edge, a third edge and a fourth edge; and a coupling assembly including a first mating portion and a second mating portion, said first mating portion being attached to said panel and being positioned generally adjacent to said first edge, said second mating portion being attached to an inner surface of said bag assembly, said first and second mating portions being removably coupled together, said first mating portion generally extends along said first edge of said panel and said second mating portion generally extends between said bottom wall and said opening along at least one lateral side thereof.

2. The apparatus according to claim 1, further including a plurality of loops being attached to said peripheral wall, said loops being positioned generally adjacent to said opening, an elongated flexible tether having a first end and a second end, said tether extending through said loops, said first and second ends each being attached to said back side and being positioned generally adjacent to said bottom wall.

3. The apparatus according to claim 1, further including a pocket being attached to said front side, said pocket having an insulated lining.

4. The apparatus according to claim 1, further including a cylindrical bottle holder being attached to said hag assembly.

5. The apparatus according to claim 1, wherein said first and second mating portions comprise a pair of zipper elements.

6. A tote bag and beach towel combination apparatus comprising:

a bag assembly including a bottom wall and a peripheral wall being attached to and extending upwardly from said bottom wall, said peripheral wall having an upper edge defining an opening extending into said bag assembly, said bottom wall having a generally rounded shape, said bag assembly having a front side, a hack side and a pair of lateral sides;

a plurality of loops being attached to said peripheral wall, said loops being positioned generally adjacent to said opening, said loops being aligned with each other along said front and lateral sides;

an elongated flexible tether having a first end and a second end, said tether extending through said loops, said first and second ends each being attached to said back side and being positioned generally adjacent to said bottom wall;

a pocket being attached to said front side, said pocket having an insulated lining;

a bottle holder being attached to said bag assembly;

a flexible panel having a first edge, a second edge, a third edge and a fourth edge, said flexible panel having a length from said first edge to said second edge greater than 40 inches and a width from said third edge to said fourth edge greater than 30 inches; and a coupling assembly including a first mating portion and a second mating portion, said first mating portion being attached to said panel and being positioned generally adjacent to said first edge, said second mating portion being attached to said bag assembly, said first mating portion generally extending along said first edge and said second mating portion generally extending between said bottom will and said opening along at least one lateral side thereof, said first and second mating portions being removably coupled together.

* * * * *